US008991981B2

(12) United States Patent
Enomoto et al.

(10) Patent No.: US 8,991,981 B2
(45) Date of Patent: Mar. 31, 2015

(54) LIQUID EJECTING HEAD AND LIQUID EJECTING APPARATUS

(71) Applicant: Seiko Epson Corporation, Tokyo (JP)

(72) Inventors: Katsumi Enomoto, Koza-gun (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/452,913

(22) Filed: Aug. 6, 2014

(65) Prior Publication Data

US 2015/0042724 A1 Feb. 12, 2015

(30) Foreign Application Priority Data

Aug. 9, 2013 (JP) ..... 2013-167009

(51) Int. Cl.
*B41J 2/14* (2006.01)

(52) U.S. Cl.
CPC ..... *B41J 2/14* (2013.01); *B41J 2002/14491* (2013.01); *B41J 2/14072* (2013.01); *B41J 2/1404* (2013.01)
USPC ..... 347/50; 347/58; 347/59; 347/65

(58) Field of Classification Search
CPC ..... B41J 2002/14491; B41J 2/14; B41J 2/14072; B41J 2202/13; B41J 2/1404
USPC ..... 347/50, 58, 59, 65, 68
See application file for complete search history.

(56) References Cited

U.S. PATENT DOCUMENTS

2010/0091071 A1 4/2010 Owaki

FOREIGN PATENT DOCUMENTS

| | | |
|---|---|---|
| EP | 1323532 | 12/2002 |
| EP | 1323532 | 7/2003 |
| EP | 1712365 | 10/2006 |
| JP | 2010-115918 | 5/2010 |

OTHER PUBLICATIONS

European Search Report for Application No. 14180556.4 dated Nov. 21, 2014.

*Primary Examiner* — Henok Legesse
(74) *Attorney, Agent, or Firm* — Workman Nydegger

(57) ABSTRACT

A liquid ejecting head includes a head chip in which two or more nozzle groups are disposed, a first inlet that communicates with one of the nozzle groups and a second inlet that communicates with the other nozzle group a wiring member that is disposed between the first second inlets, a first connection flow path that is connected to the first inlet, a second connection flow path that is connected to the second inlet, and a wiring substrate to which the wiring member is connected between the first connection flow path and the second connection flow path.

20 Claims, 8 Drawing Sheets

LIQUID EJECTING HEAD AND LIQUID EJECTING APPARATUS

CROSS REFERENCE TO RELATED APPLICATIONS

The present application claims priority to Japanese Patent Application No. 2013-167009 filed on Aug. 9, 2013 which is hereby incorporated by reference in its entirety.

BACKGROUND

1. Technical Field

Embodiments of the present invention relate to a liquid ejecting head that ejects a liquid from a nozzle, and to a liquid ejecting apparatus. More particularly, embodiments relate to an ink jet type recording head that discharges a liquid such as ink, and to an ink jet type recording apparatus.

2. Related Art

Representative examples of liquid ejecting heads that discharge liquid droplets include ink jet type recording heads that discharge ink droplets. Proposed as an example of the ink jet type recording heads is an ink jet type recording head that includes a head chip that has a flow path forming substrate where a pressure generating chamber communicating with a nozzle is formed, and a case member where a wiring substrate that is connected to a pressure generating unit which is disposed in the head chip is held Thea wiring substrate and the pressure generating unit of the head chip are interconnected via a wiring member such as a chip-on-flex (COF) (for example, refer to JP-A-2010-115918).

However, when two communication ports that are disposed in the head chip are disposed in proximity to each other, an area where a connection between a conductive member such as the COF and the wiring substrate is performed between connection flow paths respectively connected to the two communication ports is narrowed. As a result, it is difficult to perform the connection between the conductive member and the wiring substrate.

In addition, the disadvantage of an increased size of the head arises when the two communication ports are separated.

These disadvantages are not limited to the ink jet type recording head, and are present in a similar manner in liquid ejecting heads ejecting other liquids.

SUMMARY

An advantage of some embodiments of the invention is to provide a liquid ejecting head and a liquid ejecting apparatus that can be compact in size.

According to an embodiment of the invention, a liquid ejecting head is provided. The liquid ejecting head includes a head chip in which two or more nozzle groups, each being configured by a plurality of nozzles, are disposed in a reference direction on a liquid ejecting surface. A first inlet is disposed on the surface side of the head chip opposite to the liquid ejecting surface to communicate with one of the nozzle groups and a second inlet that communicates with the other nozzle group are disposed in the reference direction. The head chip includes a wiring member with one end portion connected to a pressure generating unit, which is disposed between the first inlet and the second inlet to generate a pressure change in a flow path in the head chip. The other end portion of the wiring member extends in the direction opposite to a direction of liquid ejection from the nozzles. The head chip includes a first connection flow path is connected to the first inlet, a second connection flow path is connected to the second inlet, and a wiring substrate to which the other end portion of the wiring member is connected between the first connection flow path and the second connection flow path. The second connection flow path has an extending flow path that extends from the second inlet toward the reference direction separated from the first inlet, and the wiring substrate is arranged on the side of the second connection flow path opposite to the first inlet from the extending flow path to extend in the reference direction beyond the second connection flow path from between the first connection flow path and the second connection flow path.

In this aspect, the wiring member and the wiring substrate can be interconnected between the first connection flow path and the second connection flow path without widening a gap between the first inlet and the second inlet. As a result, the head chip can be compact in size and the connection between the wiring member and the wiring substrate can be ensured. In addition, inconveniences such as a disconnection of the wiring member attributable to excessive bending can be suppressed since the wiring member does not have to be extended outside the connection flow path.

Herein, the first connection flow path and the second connection flow path may be connected to a common flow path that is common on the side of the wiring substrate opposite to the first inlet and the second inlet. In this case, it is difficult to extend the wiring member beyond the common flow path since the first inlet and the second inlet are connected to the common flow path, but the connection between the wiring member and the wiring substrate can be ensured between the first connection flow path and the second connection flow path further downstream than the common flow path.

In addition, the liquid ejecting head may include a first head chip where two or more nozzle groups are disposed and a second head chip where two or more nozzle groups are disposed. The first inlet and the second inlet are respectively disposed in each of the first head chip and the second head chip. The first head chip and the second head chip are disposed in a first direction so that the first inlet is on the second head chip side in the first head chip and the first inlet is on the first head chip side in the second head chip. In this case, a gap between the first head chip and the second head chip can be narrowed in a state where interference between the first connection flow path connected to the first inlet of the first head chip and the first connection flow path connected to the first inlet of the second head chip is suppressed. Accordingly, the head can be compact in size.

In addition, the wiring substrate may have an opening portion into which the first connection flow path of the first head chip and the first connection flow path of the second head chip are inserted. In this case, processing of the wiring substrate can be facilitated and costs can be reduced.

In addition, can the wiring member of the first head chip and the wiring member of the second head chip be inserted into the opening portion. In this case, the wiring member can be inserted with ease into the opening portion with a large opening area and assemblability can be improved.

In addition, the first connection flow path can be linearly formed in the direction of liquid ejection. The first connection flow path of the first head chip, the first connection flow path of the second head chip, the wiring member that is disposed to be upright in the direction of liquid ejection of the first head chip, and the wiring member that is disposed to be upright in the direction of liquid ejection of the second head chip be inserted into the opening portion. In this case, the wiring member can be inserted with ease into the opening portion with a large opening area and assemblability can be improved. In addition, the wiring area can be ensured and the wiring substrate can be compact in size, by decreasing the opening area of the opening portion, when the first connection flow path that is linearly disposed in the direction of liquid ejection and the wiring member that is disposed to be upright in the direction of liquid ejection are inserted into the opening portion.

In addition, the other end portion side of the wiring member can be bent along a surface of the wiring substrate in a direction separated from the first inlet in the first direction and can be connected to the wiring substrate. In this case, the wiring member can have a low back when the wiring member is bent and the connection between the wiring member and the wiring substrate can be performed with ease. As such, assemblability can be improved.

In addition, a terminal portion can be disposed on the surface of the wiring substrate and a surface of connection between the wiring member and the terminal portion can be in a direction along the surface of the wiring substrate. In this case, the wiring member and the terminal portion can be interconnected from one surface side.

In addition, the extending flow path can extend in a horizontal direction that is orthogonal to the direction of liquid ejection. In this case, the first connection flow path and the second connection flow path can be separated as far as possible in a short flow path length.

In addition, the wiring member can be formed from a sheet-shaped member, a drive circuit that drives the pressure generating unit can be disposed on one surface of the wiring member, and the distance from the drive circuit to the second inlet can be shorter than the distance from the drive circuit to the first inlet.

Further, according to another aspect of the invention, a liquid ejecting apparatus that includes the liquid ejecting head described above is provided. In this case, the liquid ejecting apparatus can be compact in size.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, embodiments of the invention will be described in detail with reference to the accompanying drawings.

Figure 1:
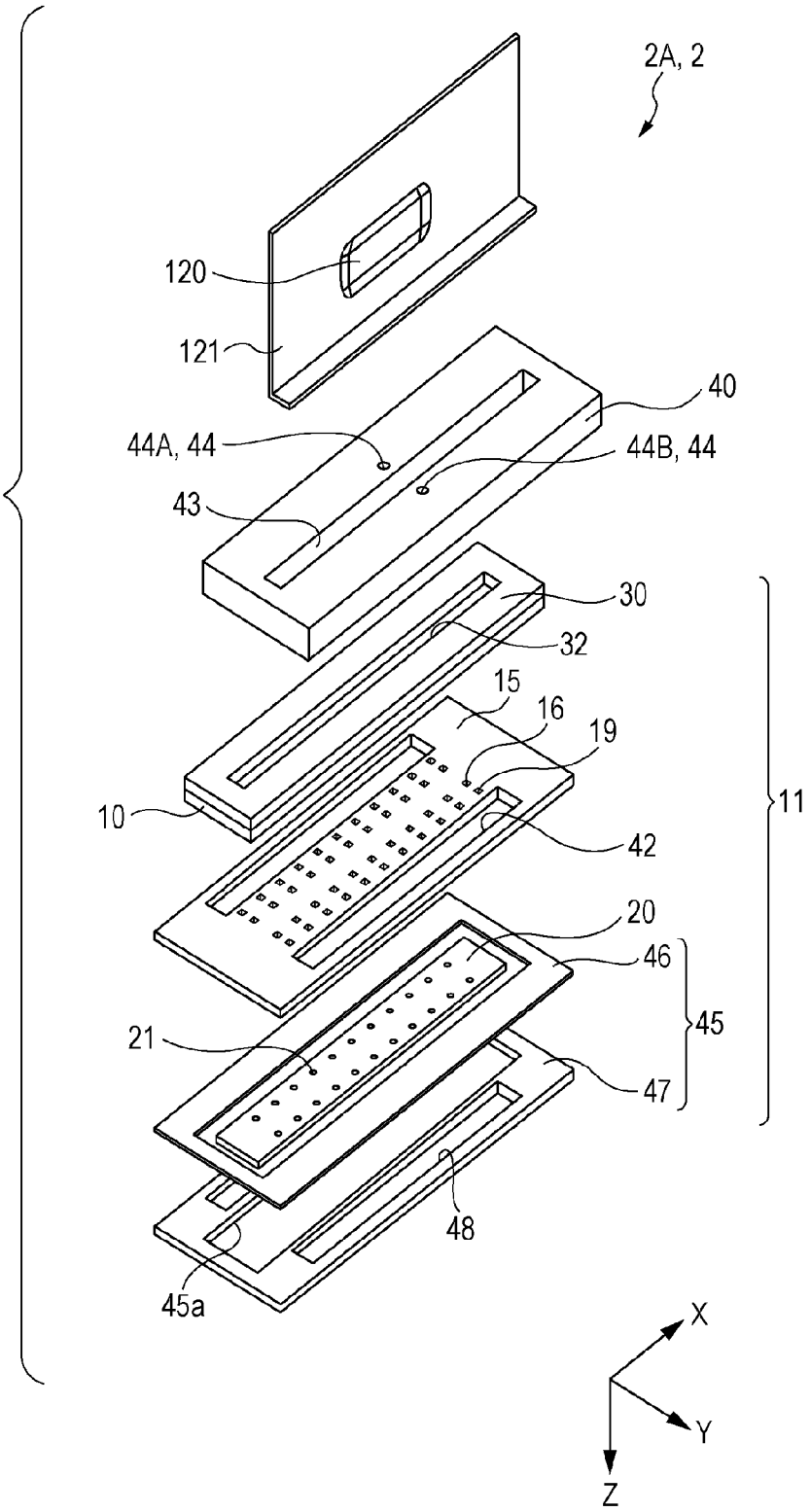
FIG. 1 is an exploded perspective view of an example of a first head chip.
Figure 2:
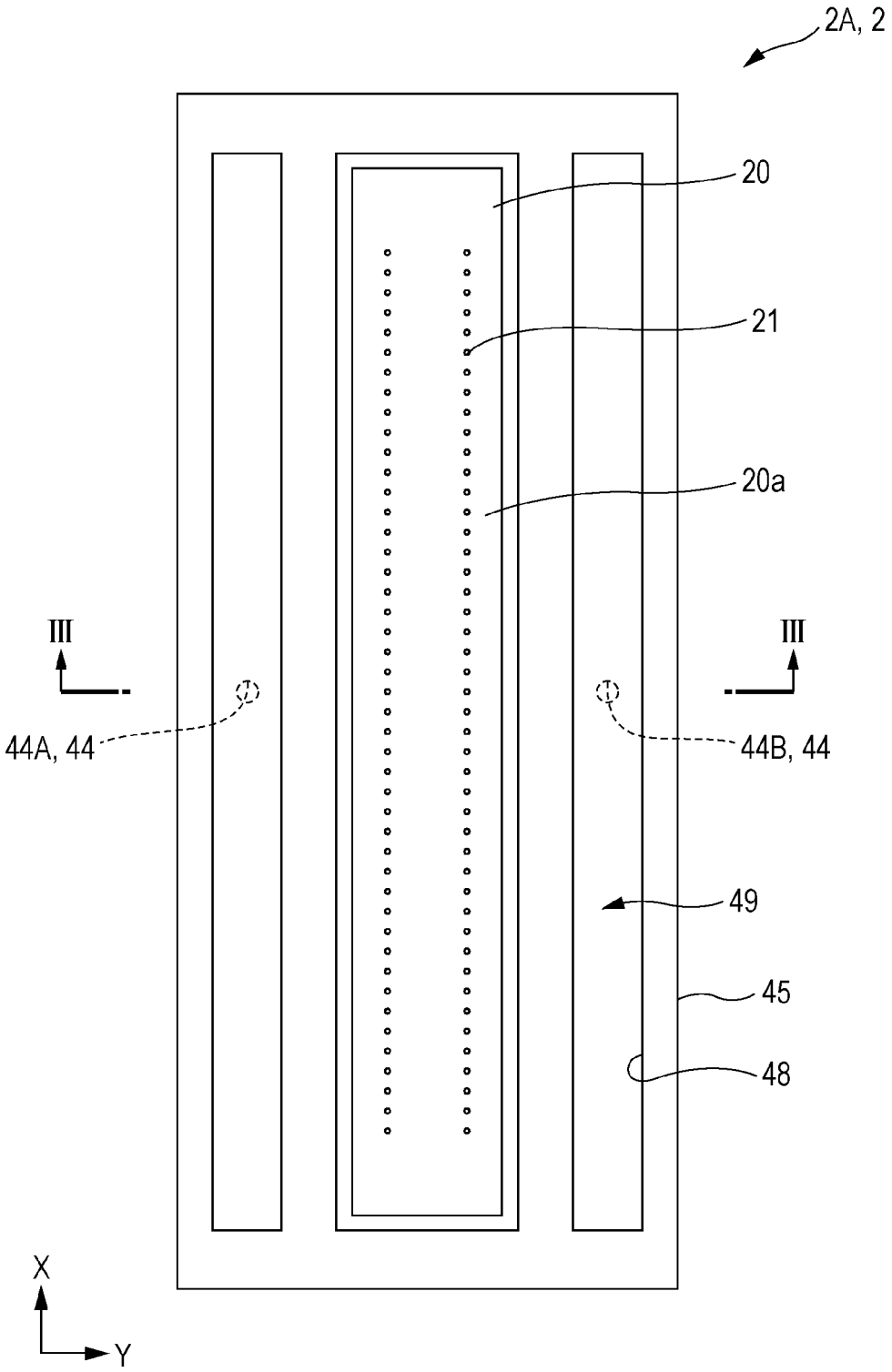
FIG. 2 is a plan view of the first head chip.
Figure 3:
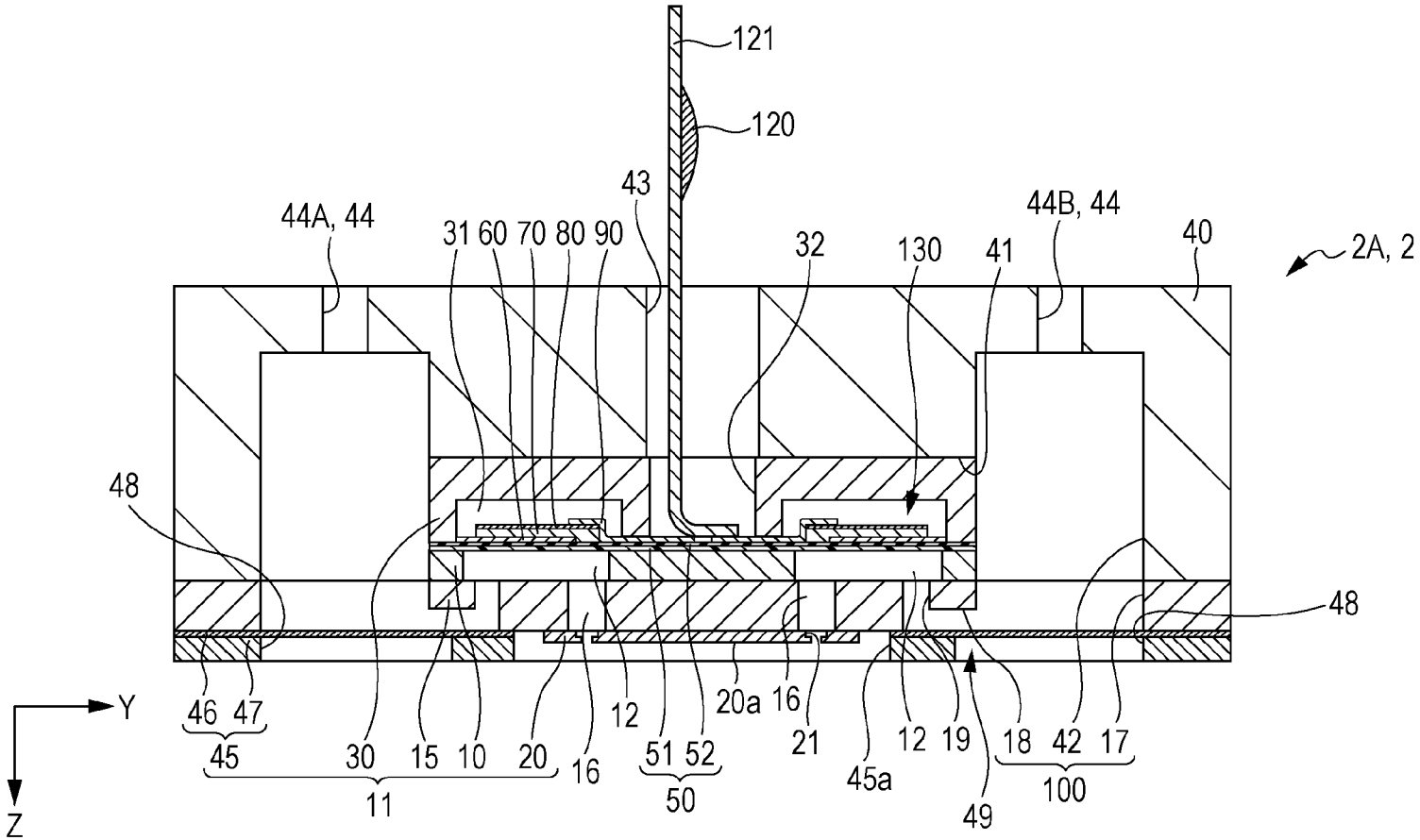
FIG. 3 is a sectional view of the first head chip.

Firstly, an example of a head chip that is disposed in an ink jet type recording head (hereinafter, simply referred to as a recording head) which is an example of a liquid ejecting head according to one embodiment of the invention will be described. FIG. 1 is an exploded perspective view of an example of a first head chip. FIG. 2 is a plan view of the first head chip. FIG. 3 is a sectional view of the first head chip.

As illustrated in the drawings, the head chip is a first head chip 2A that is mounted on the ink jet type recording head which is an example of the liquid ejecting head. The first head chip 2A includes a plurality of members such as a head main body 11 and a case member 40 that is fixed to one side surface of the head main body 11. In addition, the head main body 11 includes a flow path forming substrate 10, a communicating plate 15 that is disposed on one surface side of the flow path forming substrate 10, a nozzle plate 20 that is disposed on the surface side of the communicating plate 15 opposite to the flow path forming substrate 10, a protective substrate 30 that is disposed on the side of the flow path forming substrate 10 opposite to the communicating plate 15, and a compliance substrate 45 that is disposed on the surface side of the communicating plate 15 where the nozzle plate 20 is disposed.

A metal such as stainless steel and Ni, a ceramic material typified by $ZrO_2$ or $Al_2O_3$, an oxide such as a glass ceramic material, MgO, and $LaAlO_3$, and the like can be used in the flow path forming substrate 10 that constitutes or is included in the head main body 11. In one embodiment, the flow path forming substrate 10 may be formed of a silicon single crystal substrate. A plurality of pressure generating chambers 12 that are partitioned by a partition wall are juxtaposed on the flow path forming substrate 10 through anisotropic etching from the one surface side. Hereinafter, this direction is referred to as a direction of juxtaposition of the pressure generating chambers 12, or a first direction X. In addition, a plurality of rows in which the pressure generating chambers 12 are juxtaposed in the first direction X, two rows in one embodiment, are disposed on the flow path forming substrate 10. Hereinafter, an array direction in which the plurality of rows of the pressure generating chambers 12, in which the pressure generating chambers 12 are formed in the first direction X, are disposed is referred to as a second direction Y. Further, a direction that is orthogonal to the first direction X and the second direction Y is referred to as a direction of discharge of ink droplets (liquid droplets) or a third direction Z. The flow path forming substrate 10, the communicating plate 15, and the nozzle plate 20 are stacked in the third direction Z.

In addition, a supply path, which has a smaller opening area than the pressure generating chambers 12 and provides a flow path resistance for ink which flows into the pressure generating chambers 12, and the like may be disposed on one end portion sides of the pressure generating chambers 12 in the second direction Y on the flow path forming substrate 10.

In addition, the communicating plate 15 and the nozzle plate 20 are sequentially stacked on the one surface side of the flow path forming substrate 10. In other words, the communicating plate 15 is disposed on the one surface of the flow path forming substrate 10. The nozzle plate 20 is disposed on the surface side of the communicating plate 15 opposite to the flow path forming substrate 10. Nozzles 21 are provided in the nozzle plate 20.

Nozzle communicating paths 16, which allow the pressure generating chambers 12 and the nozzles 21 to communicate with each other, are disposed in the communicating plate 15. The communicating plate 15 is larger in area than the flow path forming substrate 10, and the nozzle plate 20 is smaller in area than the flow path forming substrate 10. When the communicating plate 15 is disposed in this manner, the nozzles 21 of the nozzle plate 20 and the pressure generating chambers 12 are separated. Thus, ink in the pressure generating chambers 12 is unlikely to be affected by thickening caused by the evaporation of moisture in ink that occurs in ink in the vicinity of the nozzles 21. In addition, the nozzle plate 20 has only to cover openings of the nozzle communicating paths 16 that allow the pressure generating chambers 12 and the nozzles 21 to communicate with each other. Thus the area of the nozzle plate 20 can be relatively small with reduced costs. In one embodiment, a surface to which ink droplets are discharged with the nozzles 21 of the nozzle plate 20 open is referred to as a liquid ejecting surface 20*a*.

In addition, a first manifold portion 17 and a second manifold portion 18 constitute a part of a manifold 100 and are disposed on or in the communicating plate 15.

The first manifold portion 17 is disposed to penetrate the communicating plate 15 in a thickness direction (stacking direction of the communicating plate 15 and the flow path forming substrate 10).

In addition, the second manifold portion 18 is disposed to be open to the nozzle plate 20 side of the communicating plate 15, without completely penetrating the communicating plate 15 in the thickness direction.

Furthermore, in the communicating plate 15, supply communicating paths 19 that communicate with the one end portions of the pressure generating chambers 12 in the second direction Y are disposed independently in or for the respective pressure generating chambers 12. The supply communicating path 19 allows the second manifold portion 18 and the pressure generating chamber 12 to communicate with each other. In other words, in one embodiment, the supply communicating paths 19, the pressure generating chambers 12, and the nozzle communicating paths 16 are disposed as individual flow paths communicating with the nozzles 21 and the second manifold portions 18. The ink flows from the manifold portion 17 to the second manifold portion 18, to the supply communicating path 19, to the pressure chamber 12, to the nozzle communicating path 16 and can be ejected from the nozzles 21 as ink droplets.

A metal such as stainless steel and nickel (Ni), ceramics such as zirconium (Zr), or the like can be used as the communicating plate 15. It is preferable that the communicating plate 15 employ a material whose linear expansion coefficient is equal to that of the flow path forming substrate 10. In other words, in a case where a material whose linear expansion coefficient is significantly different from that of the flow path forming substrate 10 is used as the communicating plate 15, warpage occurs through heating and cooling due to the difference between the linear expansion coefficient of the flow path forming substrate 10 and the linear expansion coefficient of the communicating plate 15. In one embodiment, the same material, (e.g., silicon single crystal substrate) is used as the communicating plate 15 as well as in the flow path forming substrate 10. Thus the occurrence of warpage caused by heat, cracks and peeling caused by heat, and the like can be suppressed.

The nozzles 21, which communicate with the pressure generating chambers 12 via the nozzle communicating paths 16, are formed on the nozzle plate 20. In other words, the nozzles 21 that eject the same type of liquid (ink) are juxtaposed in the first direction X, and two rows of the nozzles 21 juxtaposed in the first direction X are formed in the second direction Y.

In other words, in one embodiment, a nozzle group that is disposed on the liquid ejecting surface 20*a* is a row of the nozzles juxtaposed in the first direction X, and the number of the rows of the nozzles (nozzle groups) disposed in the second direction Y, which is a reference direction, is two. Herein, the nozzle group is not limited to the nozzle group that is juxtaposed linearly in the first direction X. For example, the nozzle group may be a nozzle group that is configured such that the nozzles 21 juxtaposed in the first direction X are alternately arranged at positions shifted in the second direction Y in a so-called zigzag arrangement. In addition, the nozzle group may be configured such that a plurality of the nozzles 21 juxtaposed in the first direction X are arranged in the second direction Y in a shifted manner. In other words, the nozzle group may be configured by using the plurality of nozzles 21 disposed on the liquid ejecting surface 20*a*, and the arrangement thereof is not particularly limited. However, in most cases, the direction in which the nozzles 21 are juxtaposed (first direction X) increases in length when the plurality of nozzles 21 (different nozzles) are arranged in high density. In other words, it is usual that the first direction X is a longitudinal direction and the second direction Y is a short direction in the head chip 2.

In addition, the pressure generating chambers 12 are arranged to correspond to the nozzles 21. Pressure generating units, which generate pressure changes in the ink, are disposed to correspond to the pressure generating chambers 12. Thus the plurality of pressure generating chambers 12 and a plurality of piezoelectric actuators 130, which are examples of the pressure generating units, are juxtaposed in the first direction X. A wiring member 121 (described in detail later), which supplies an electrical signal to the plurality of piezoelectric actuators 130 formed in high density, is connected to the piezoelectric actuators 130 by generating a space in a direction of juxtaposition of the piezoelectric actuators 130 on the substrate, that is, the first direction X (longitudinal direction). Accordingly, the width of the sheet-shaped wiring member 121 is arranged in the direction of juxtaposition of the piezoelectric actuators 130. In other words, when the width direction of the sheet-shaped wiring member 121 is the direction of juxtaposition of the piezoelectric actuators 130, the connection between the piezoelectric actuators 130 and the wiring member 121 can be performed smoothly even if the piezoelectric actuators 130 are arranged with a high density.

A metal such as stainless steel (SUS), an organic material such as a polyimide resin, a silicon single crystal substrate, or the like can be used as the nozzle plate 20. When a silicon single crystal substrate is used as the nozzle plate 20, the occurrence of warpage caused by heating and cooling, cracks and peeling caused by heat, and the like can be suppressed since the linear expansion coefficients of the nozzle plate 20 and the communicating plate 15 are equal to each other.

A vibrating plate 50 is formed on the surface side of the flow path forming substrate 10 opposite to the communicating plate 15. In one embodiment, an elastic membrane 51 formed of silicon oxide, which is disposed on the flow path forming substrate 10 side, and an insulator film 52 formed of zirconium oxide, which is disposed on the elastic membrane 51, are disposed as the vibrating plate 50. A liquid flow path such as the pressure generating chambers 12 is formed through anisotropic etching of the flow path forming substrate 10 from the one surface side (e.g., surface side where the nozzle plate 20 is bonded), and the other surface of the liquid flow path such as the pressure generating chambers 12 are defined by the elastic membrane 51.

In addition, a first electrode 60, a piezoelectric layer 70, and a second electrode 80 are formed to be stacked on the insulator film 52 of the vibrating plate 50 and constitute the piezoelectric actuator 130. Herein, the piezoelectric actuator 130 refers to a part that has the first electrode 60, the piezoelectric layer 70, and the second electrode 80. In general, any one of the electrodes of the piezoelectric actuator 130 is a common electrode, and the other electrode and the piezoelectric layer 70 are configured through patterning in each of the pressure generating chambers 12. Herein, a part that is configured by any one of the electrodes that is patterned and the piezoelectric layer 70 and is subjected to piezoelectric distortion caused through voltage application to both of the electrodes is referred to as a piezoelectric active portion. In one embodiment, the first electrode 60 is the common electrode of the piezoelectric actuator 130 and the second electrode 80 is an individual electrode of the piezoelectric actuator 130. However, this may be reversed for the convenience of a drive circuit and wiring. In the example described above, the first electrode 60 is continuously disposed across the plurality of pressure generating chambers 12, and thus the first electrode 60 functions as a part of the vibrating plate. However, for example, only the first electrode 60 may serve as the vibrating plate, without being limited thereto, with the elastic membrane 51 and the insulator film 52 described above not disposed. In addition, the piezoelectric actuator 130 itself may serve practically as the vibrating plate. However, the first electrode 60 can be protected by an insulating protective film or the like, so as to prevent conduction between the first electrode 60 and the ink, in a case where the first electrode 60 is disposed directly on the flow path forming substrate 10. In other words, although an example in which the first electrode 60 is configured to be disposed on the substrate (flow path forming substrate 10) via the vibrating plate 50 is described in one embodiment, the first electrode 60 may be disposed directly on the substrate, without being limited thereto, with the vibrating plate 50 not disposed. In other words, the first electrode 60 may serve as the vibrating plate. In other words, to be on the substrate includes a state where another member is interposed (upward) therebetween as well as to be directly on the substrate.

Furthermore, one end portions of the lead electrodes 90, which are drawn out of the vicinity of the end portions on the side opposite to the supply communicating paths 19, extend onto the vibrating plate 50, and are formed of gold (Au) or the like, are respectively connected to the second electrodes 80 that are the individual electrodes of the piezoelectric actuators 130. In addition, the wiring member 121 where a drive circuit 120 (described later) is disposed to drive the piezoelectric actuators 130, which are the pressure generating units, is connected to the other end portions of the lead electrodes 90. A flexible sheet-shaped wiring member such as a COF substrate can be used as the wiring member 121. The drive circuit 120 may not be disposed in the wiring member 121. In other words, the wiring member 121 is not limited to the COF substrate, and may include FFC, FPC, and the like.

The other end portions of the lead electrodes 90 connected to the wiring member 121 are disposed to be juxtaposed in the first direction X. It is possible to extend the other end portions of the lead electrodes 90 to the one end portion side of the flow path forming substrate 10 in the first direction X and juxtapose the other end portions of the lead electrodes 90 in the second direction Y. However, this results in an increase in the size and costs of the recording head because a space is required for the lead electrodes 90 to be routed. In addition, the width of the lead electrodes decreases and electrical resistance increases when multiple piezoelectric actuators 130 are disposed in a high density to increase the number of the nozzles. Accordingly, the piezoelectric actuators 130 may not be in normal driving with the lead electrodes 90 routed and the electrical resistance further increased. In one embodiment, the other end portion sides of the lead electrodes 90 extend between the two rows of the piezoelectric actuators 130 juxtaposed in the first direction X and the other end portions of the lead electrodes 90 are juxtaposed in the first direction X so that the recording head 1 can be compact in size and lower in cost with no increase in size, an increase in electrical resistance can be suppressed in the lead electrodes 90, and the number of the nozzles can be increased with the multiple piezoelectric actuators 130 disposed in high density.

In addition, in one embodiment, the other end portions of the lead electrodes 90 are disposed between the rows of the piezoelectric actuators 130 in the second direction Y and the lead electrodes 90 and the wiring member 121 are connected with each other between the rows of the piezoelectric actuators 130. Thus the one wiring member 121 can be connected to two rows of the piezoelectric actuators 130 via the lead electrodes 90. The wiring member 121 is not limited thereto in number, and the wiring member 121 may be disposed in each of the rows of the piezoelectric actuators 130. When one wiring member 121 is disposed with the two rows of the piezoelectric actuators 130 in one embodiment, a space where the wiring member 121 and the lead electrode 90 are connected with each other can be narrow and the recording head 1 can be compact in size. In a case where the wiring member 121 is disposed in each of the rows of the piezoelectric actuators 130, it is also possible to extend the lead electrodes 90 to the side opposite to the rows of the piezoelectric actuators 130. However, in such a configuration, an even wider space is required for the connection of the lead electrode with the wiring member and the number of the areas where the wiring member 121 is drawn out to the case member and the like becomes two, which results in the recording head 1 becoming larger in size. In other words, the two rows of the piezoelectric actuators 130 can be connected at the same time with the one wiring member 121 when the lead electrodes 90 are disposed between the two rows of the piezoelectric actuators 130 in one embodiment. The width direction of the sheet-shaped wiring member 121, which is connected to the lead electrodes 90 in this manner, is arranged in the first direction X.

In addition, the protective substrate 30, which has substantially the same size as the flow path forming substrate 10, is bonded to the surface of the flow path forming substrate 10 on the side toward the piezoelectric actuators 130, which are the pressure generating units. The protective substrate 30 includes holding portions 31, which are spaces in which the piezoelectric actuators 130 are protected. The holding portions 31 are disposed independently in the respective rows configured with the piezoelectric actuators 130 juxtaposed in the first direction X. A thickness-direction through-hole 32 is disposed between the two holding portions 31 (second direction Y). The other end portions of the lead electrodes 90 extend into and are exposed in the through-hole 32. The lead electrodes 90 and the wiring member 121 are electrically connected with each other in the through-hole 32.

In addition, the case member 40, which defines the manifolds 100 communicating with the plurality of pressure generating chambers 12 along with the head main body 11, is fixed to the head main body 11. The case member 40 has substantially the same shape, in a plan view, as the communicating plate 15 described above, and is bonded to both the protective substrate 30 and the communicating plate 15. Specifically, the case member 40 has a concave portion 41 with a depth at which the flow path forming substrate 10 and the protective substrate 30 are accommodated to the protective substrate 30 side. The concave portion 41 has an opening area which is larger than that of the surface of the protective substrate 30 bonded to the flow path forming substrate 10. An opening surface of the concave portion 41 on the nozzle plate 20 side is sealed by the communicating plate 15 in a state where the flow path forming substrate 10 and the like are accommodated in the concave portion 41. In this manner, a third manifold portion 42, which holds the liquid by using the case member 40 and the head main body 11, is defined in an outer circumferential portion of the flow path forming substrate 10. The first manifold portion 17 and the second manifold portion 18 that are disposed on the communicating plate 15 and the third manifold portion 42 that is defined by the case member 40 and the head main body 11 constitute the manifold 100 in one embodiment. In other words, the manifold 100 includes the first manifold portion 17, second manifold portion 18, and the third manifold portion 42. In addition, the manifolds 100 according to this embodiment are arranged on both outer sides of the two rows of the pressure generating chambers 12 in the second direction Y, and the two manifolds 100 that are disposed on both of the outer sides of the two rows of the pressure generating chambers 12 are disposed independently of each other so as not to communicate in the head chip 2. In other words, the manifolds 100 are disposed to communicate with the respective rows (rows juxtaposed in the first direction X) of the pressure generating chambers 12 in one embodiment. In other words, a manifold 100 is disposed for each of the nozzle groups. The two manifolds 100 may, however, communicate with each other in one embodiment.

In addition, in the case member 40, an inlet 44 is disposed to communicate with the manifolds 100 and supply ink to the respective manifolds 100. In this embodiment, the inlet 44 is disposed for each of the manifolds 100. In other words, provided are the first inlet 44A that communicates with one of the nozzle groups via one of the manifolds 100 and the second inlet 44B that communicates with the other one of the nozzle groups via the other one of the manifolds 100. The first inlet 44A and the second inlet 44B are collectively referred to as an inlet 44.

In addition, in one embodiment, the surface side where the drive circuit 120 is disposed is referred to as the second inlet 44B and the side opposite to the surface where the drive circuit 120 is disposed is referred to as the first inlet 44A. In other words, the distance between the drive circuit 120 and the second inlet 44B may be shorter than the distance between the drive circuit 120 and the first inlet 44A.

In addition, a connection port 43, which communicates with the through-hole 32 of the protective substrate 30 for the wiring member 121 to be inserted, is disposed in the case member 40. In other words, the first inlet 44A and the second inlet 44B are disposed on both sides of the connection port 43 (through-hole 32) in the second direction Y. In other words, one end portion of the wiring member 121 is connected to the piezoelectric actuators 130, which are the pressure generating units, via the lead electrodes 90 between the first inlet 44A and the second inlet 44B in the second direction Y, which is the reference direction. The other end portion of the wiring member 121 extends in the direction opposite to the penetration directions of the through-hole 32 and the connection port 43, that is, the third direction Z, which is the direction of discharge of ink droplets.

Examples of materials that can be used in the case member 40 include resins and metals. When a resinous material is molded as the case member 40, mass production is available at a low cost.

In addition, a compliance substrate 45 may be disposed on a surface of the communicating plate 15 where the first manifold portion 17 and the second manifold portion 18 are open. The compliance substrate 45 has substantially the same size, in a plan view, as the communicating plate 15 described above. A first exposing opening portion 45*a* that exposes the nozzle plate 20 is disposed in the compliance substrate 45. The openings of the first manifold portion 17 and the second manifold portion 18 on the liquid ejecting surface 20*a* side are sealed in a state where the compliance substrate 45 exposes the nozzle plate 20 by using the first exposing opening portion 45*a*.

In other words, the compliance substrate 45 defines a part of the manifold 100. The compliance substrate 45 has a sealing film 46 and a fixed substrate 47 in this embodiment. The sealing film 46 is formed of a flexible and film-shaped thin film (for example, a thin film with a thickness of 20 μm or less which is formed of polyphenylene sulfide (PPS) or the like), and the fixed substrate 47 is formed of a hard material such as a metal, examples of which include stainless steel (SUS). An area of the fixed substrate 47 facing the manifold 100 is an opening portion 48 that is completely removed in the thickness direction, and thus one surface of the manifold 100 is a compliance portion 49 that is a flexible portion and the one surface of the manifold is sealed only by the flexible sealing film 46 in one example. In one embodiment, one compliance portion 49 is disposed to correspond to one manifold 100. In other words, the number of the manifolds 100 disposed is two, and thus the number of the compliance portions 49 is two, which are disposed on both sides in the second direction Y across the nozzle plate 20.

When ink is ejected, ink is introduced via the inlet 44 and inner portions of the flow paths reaching the nozzles 21 from the manifolds 100 are filled with ink in the first head chip 2A having the configuration described herein. Then, a voltage is applied to the respective piezoelectric actuators 130, which correspond to the pressure generating chambers 12, according to a signal from the drive circuit 120 so that the vibrating plate 50 is subjected to a bending deformation along with the piezoelectric actuators 130. This results in an increase in the pressure in the pressure generating chambers 12, and ink droplets are ejected from the predetermined nozzles 21.

Figure 4:
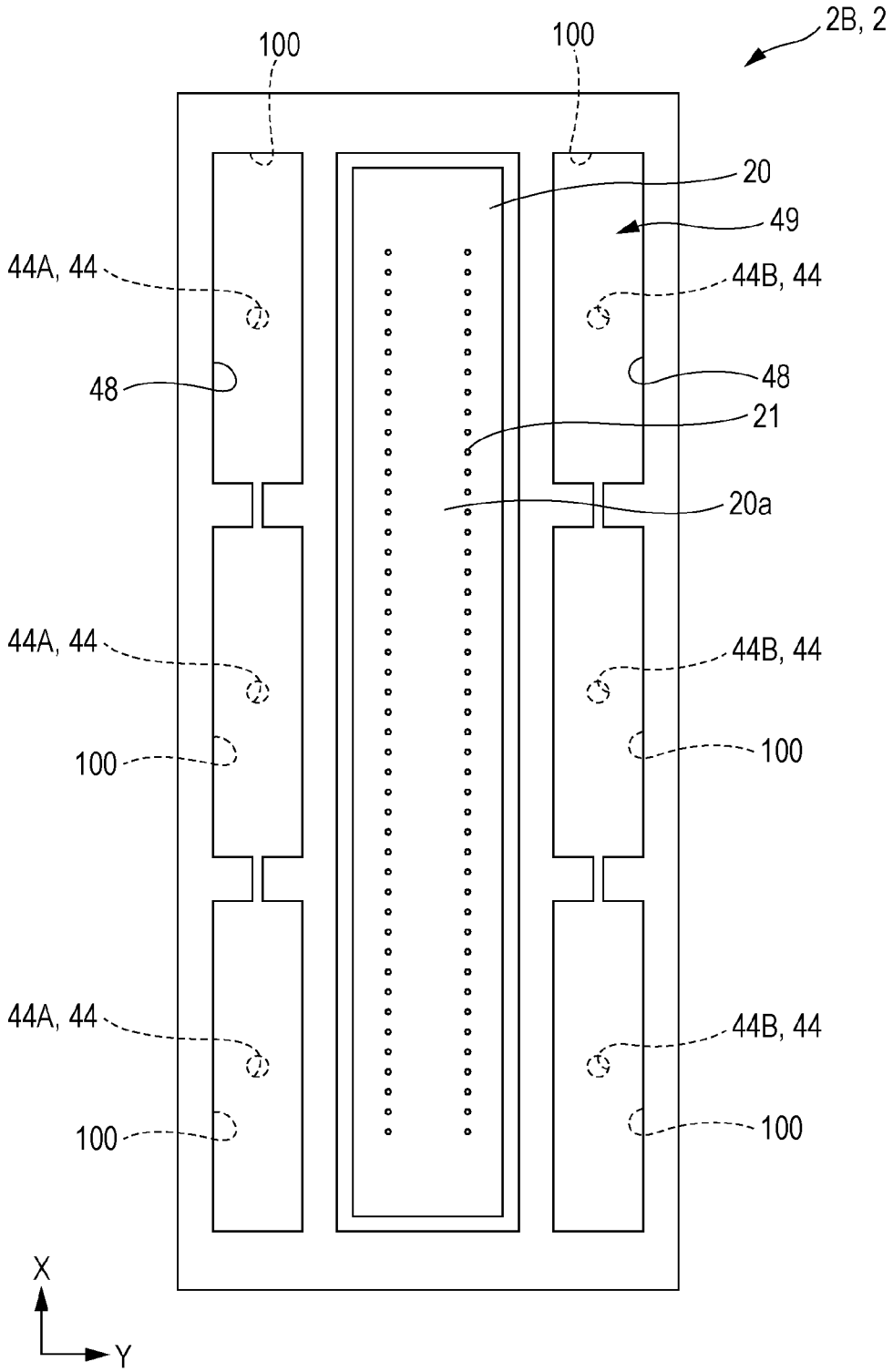
FIG. 4 is a plan view of and example of a second head chip.

The first head chip 2A has been described as an example of the head chip in one embodiment, but the invention is not particularly limited thereto. The recording head 1 may include the first head chip 2A and a second head chip 2B that has substantially the same structure as the first head chip 2A described above but with the manifolds 100 divided into three in the first direction X in one example. Hereinafter, the first head chip 2A and the second head chip 2B are collectively referred to as the head chip 2. Herein, the second head chip 2B, which is mounted on the ink jet type recording head 1 according to this embodiment, will be described with reference to FIG. 4. FIG. 4 is a plan view illustrating an example of the second head chip.

In the second head chip 2B, the manifolds 100 are disposed on both sides of the nozzles 21 in the second direction Y. In addition, the manifolds 100 that are disposed on both of the sides in the second direction Y are respectively divided into a plurality of the manifolds 100 in the first direction X, divided into three in one embodiment. In one embodiment, a total of six manifolds 100 are disposed in the second head chip 2B. In addition, the compliance portion 49 (opening portion 48) is disposed in each of the partitioned manifolds 100. Furthermore, the inlet 44 is disposed in each of the manifolds 100. In other words, the second head chip 2B according to this embodiment has two rows of the three manifolds 100 juxtaposed in the first direction X which are disposed in the second direction Y. The inlet 44 is disposed in a central portion of each of the manifolds 100 in the first direction X. Accordingly, two rows of the three inlets 44 juxtaposed in the first direction X are disposed in the second direction Y. In one embodiment, as in the first head chip 2A described above, one of the inlets 44 in the second direction Y is referred to as a first inlet 44A, and the other inlet 44 is referred to as a second inlet 44B. In other words, in the second head chip 2B, the one end portion of the wiring member 121 (not illustrated) is connected to the piezoelectric actuators 130 (not illustrated), which are the pressure generating units, via the lead electrodes 90 between the first inlet 44A and the second inlet 44B in the second direction Y, which is the reference direction, as in the first head chip 2A described above. The other end portion of the wiring member 121 extends in the direction opposite to the penetration directions of the through-hole 32 and the connection port 43, that is, the third direction Z, which is the direction of discharge of ink droplets. The basic configuration of the second head chip 2B is the same as that of the first head chip 2A and redundant description is omitted.

Figure 5:
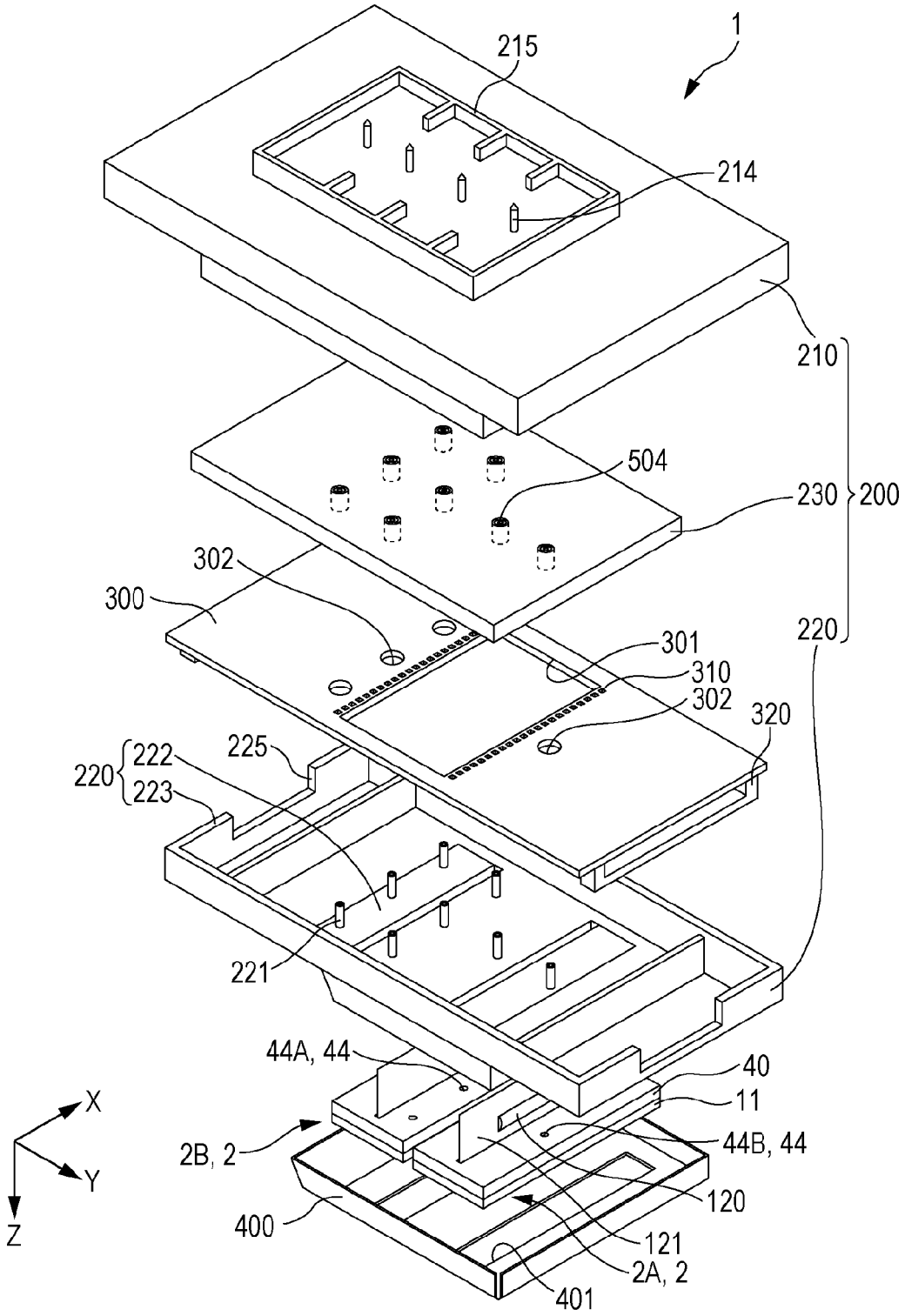
FIG. 5 is an exploded perspective view of an example of a recording head
Figure 6:
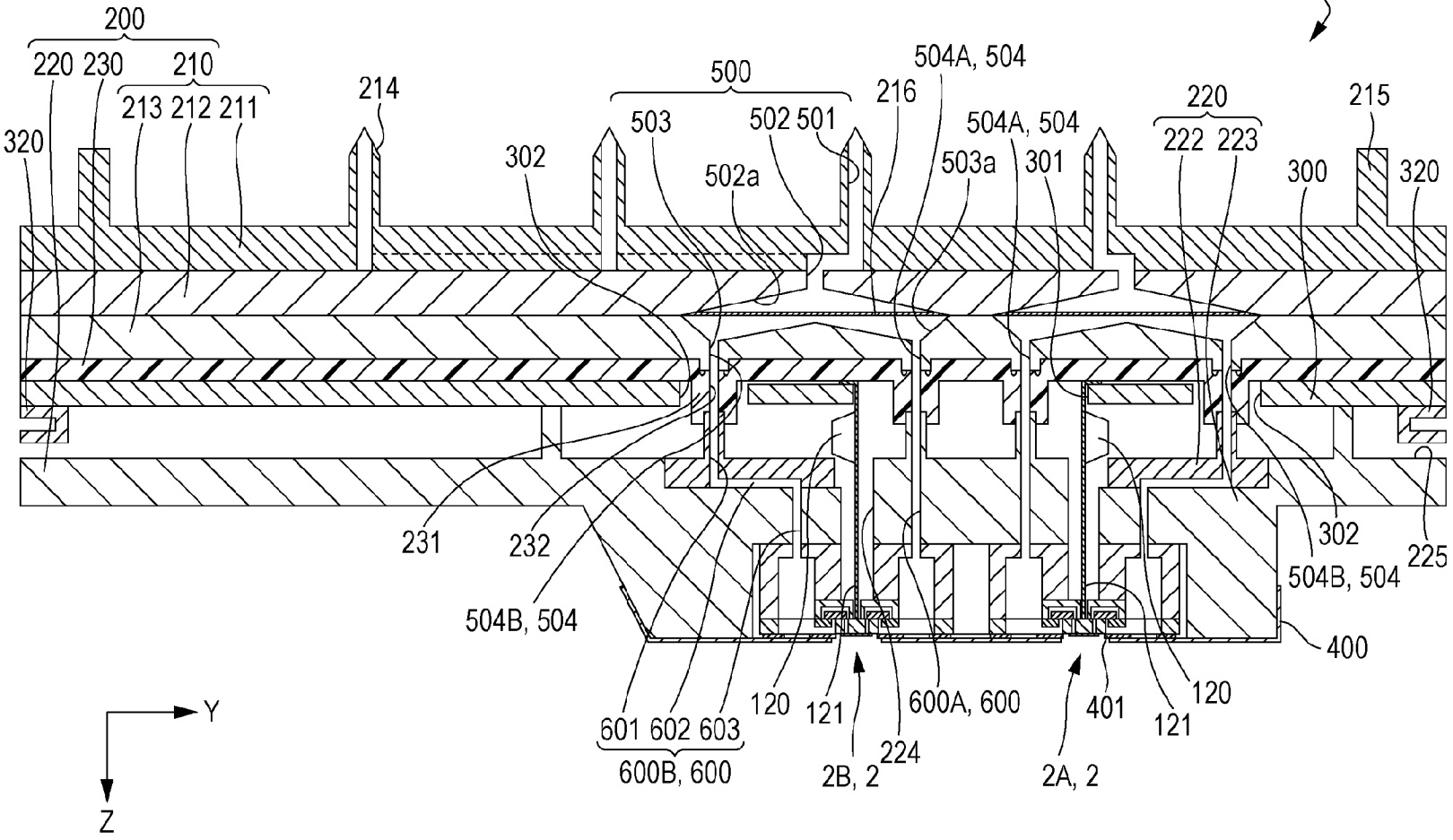
FIG. 6 is a sectional view of the recording head.
Figure 7:
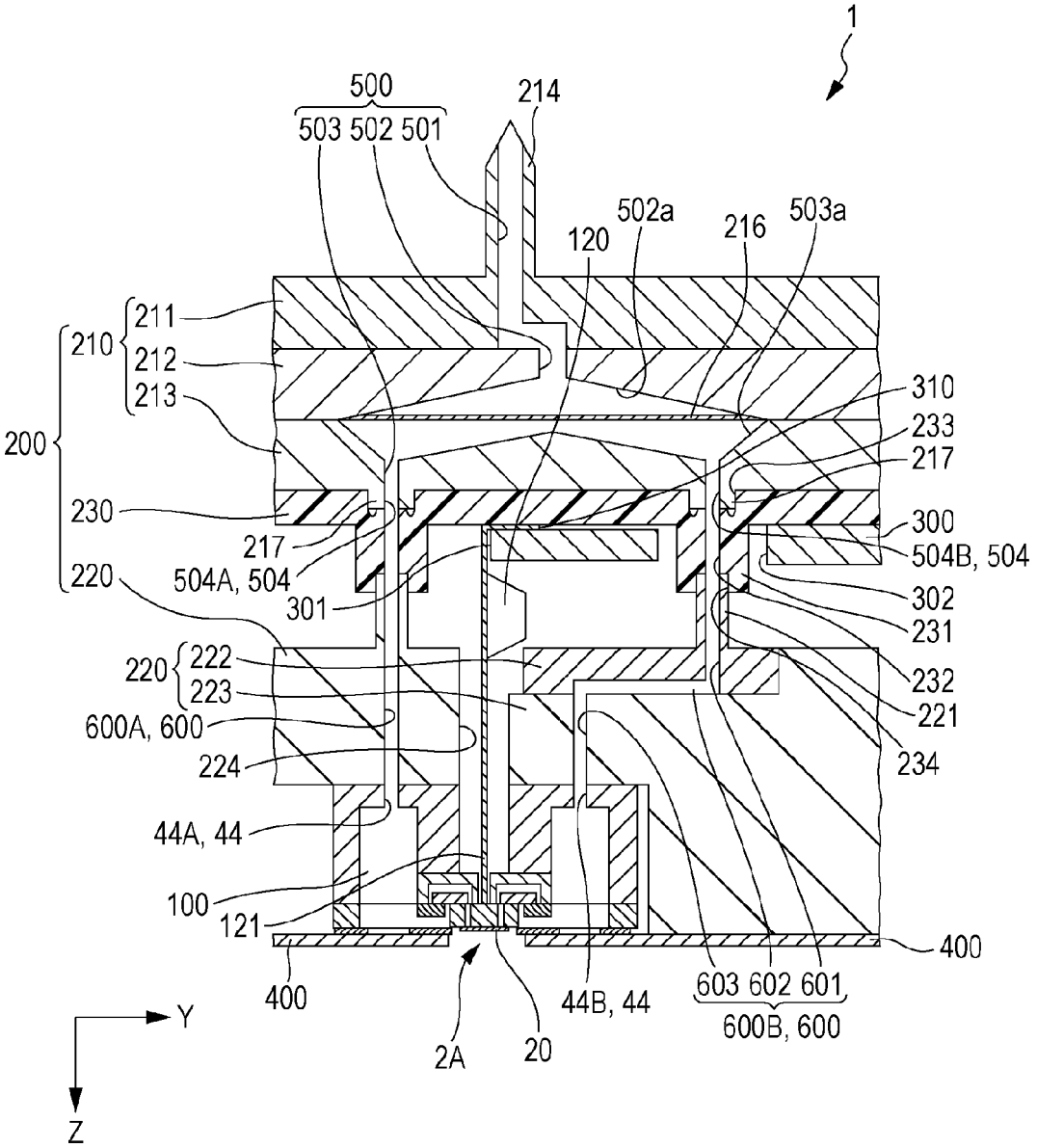
FIG. 7 is an enlarged sectional view of a main part of the recording head.

The ink jet type recording head, which is an example of the liquid ejecting head according to this embodiment including the first head chip 2A and the second head chip 2B, will be described in detail. FIG. 5 is an exploded perspective view of an example of the ink jet type recording head, which is an example of the liquid ejecting head according to one embodiment of the invention. FIG. 6 is a sectional view of the ink jet type recording head. FIG. 7 is an enlarged sectional view of a main part.

As illustrated in the drawings, the recording head 1 includes the two head chips 2 (the first head chip 2A and the second head chip 2B) that discharge ink (liquid) as ink droplets (liquid droplets) from the nozzles, a flow path member 200 that holds the two head chips 2 and supplies ink (liquid) to the head chips 2, a wiring substrate 300 that is held by the flow path member 200, and a cover head 400 that is disposed on the liquid ejecting surface 20*a* sides of the head chips 2.

The flow path member 200 includes an upstream flow path member 210 where an upstream flow path 500 is disposed, a downstream flow path member 220 where a downstream flow path 600 is disposed, and a seal member 230 that connect the upstream flow path 500 with the downstream flow path 600 in a sealed state.

In one embodiment, a first upstream flow path member 211, a second upstream flow path member 212, and a third upstream flow path member 213 are stacked in the third direction Z (direction orthogonal to the first direction X and the second direction Y), in which ink droplets are discharged, to constitute the upstream flow path member 210. However, the upstream flow path member 210 is not particularly limited thereto, and may be a single member or may be configured by using a plurality of members (e.g., two or more members). In addition, a direction in which the plurality of members constituting the upstream flow path member 210 are stacked is not particularly limited, and may be the first direction X or the second direction Y as well.

The first upstream flow path member 211 includes connection portions 214, which may be connected to a liquid holding portion, such as an ink tank and an ink cartridge where ink (liquid) is held, on the surface side opposite to the downstream flow path member 220. In one embodiment, the connection portions 214 protrude in a needle shape. The liquid holding portion such as the ink cartridge may be directly connected to the connection portions 214, and the liquid holding portion such as the ink tank may be connected via a supply tube such as a tube.

First upstream flow paths 501, to which ink is supplied from the liquid holding portion, are disposed in the connection portions 214. In addition, guide walls 215 are disposed around the connection portions 214 of the first upstream flow path member 211 so as to position the liquid holding portion in one example.

Flow paths that extend in the third direction Z to correspond to second upstream flow paths 502 (described later), flow paths that extend in planes including the directions orthogonal to the third direction Z, that is, the first direction X and the second direction Y to correspond to second upstream flow paths 502, and the like constitute the first upstream flow paths 501.

The second upstream flow path member 212 is fixed to the surface side of the first upstream flow path member 211 opposite to the connection portions 214 and includes the second upstream flow paths 502 which communicate with the first upstream flow paths 501. In addition, first liquid reservoir portions 502*a*, which are widened to be larger in inner diameter than the first upstream flow paths 501, are disposed on the downstream side (third upstream flow path member 213 side) of the second upstream flow paths 502.

The third upstream flow path member 213 is disposed on the side of the second upstream flow path member 212 opposite to the first upstream flow path member 211. In addition, third upstream flow paths 503 are disposed in the third upstream flow path member 213. Opening parts of the third upstream flow paths 503 on the second upstream flow path 502 side are second liquid reservoir portions 503*a*, which are widened to correspond to the first liquid reservoir portions 502*a*. Filters 216 may be disposed at opening parts (between the first liquid reservoir portions 502*a* and the second liquid reservoir portions 503*a*) of the second liquid reservoir portions 503*a* so as to remove bubbles and foreign substances contained in ink. As such, ink that is supplied from the second upstream flow paths 502 (first liquid reservoir portions 502*a*) is supplied to the third upstream flow paths 503 (second liquid reservoir portions 503*a*) via the filters 216.

In addition, the third upstream flow path 503 branches into two on the further downstream side (side opposite to the second upstream flow path) than the second liquid reservoir portion 503*a*, and the third upstream flow path 503 is disposed to be open, as a first outlet 504A and a second outlet 504B, on the surface of the third upstream flow path member 213 on the downstream flow path member 220 side.

In other words, the upstream flow path 500 that corresponds to one of the connection portions 214 includes the first upstream flow path 501, the second upstream flow path 502, and the third upstream flow path 503, and the upstream flow path 500 is open as the two outlets 504 (the first outlet 504A and the second outlet 504B) on the downstream flow path member 220 side. In other words, the two outlets 504 (the first outlet 504A and the second outlet 504B) are disposed to communicate with the common flow path. Thus, the third upstream flow path 503 may split into two paths that include the first and second outlets 504A and 504B.

In addition, first protruding portions 217 (see FIG. 7), which protrude toward the downstream flow path member 220 side, are disposed on the downstream flow path member 220 side of the third upstream flow path member 213. The first protruding portion 217 is disposed in each of the branching third upstream flow paths 503, and the outlets 504 are disposed to be open at respective tip end surfaces of the first protruding portions 217.

The first upstream flow path member 211, the second upstream flow path member 212, and the third upstream flow path member 213 where the upstream flow paths 500 are formed in this manner are integrally stacked by using, for example, an adhesive, welding, and the like. The first upstream flow path member 211, the second upstream flow path member 212, and the third upstream flow path member 213 can also be fixed by using a screw, a clamp, and the like. However, bonding may be performed by using an adhesive, welding, and the like so as to suppress the leakage of ink (liquid) from connection parts reaching the third upstream flow paths 503 from the first upstream flow paths 501.

In one embodiment, four connection portions 214 are disposed in one upstream flow path member 210 and four independent upstream flow paths 500 are disposed in one upstream flow path member 210. Because each of the upstream flow paths 500 branches into two on the downstream flow path member 220 side, the total number of the inlets 44 disposed is eight. A configuration in which the upstream flow path 500 branches into two further downstream (downstream flow path member 220 side) than the filter 216 has been illustrated as an example in one embodiment. However, embodiments of the invention are not limited thereto, and the upstream flow path 500 may branch into three or more paths on the further downstream side than or from the filter 216. In addition, the one upstream flow path 500 may not branch further downstream than the filter 216.

The downstream flow path member 220 includes the downstream flow path 600 that is connected to the upstream flow path 500. A second protruding portion 221, which protrudes to the upstream flow path member 210 side, is disposed in the downstream flow path member 220. The second protruding portion 221, which corresponds to the first protruding portion 217, is disposed in or for each of the upstream flow paths 500, that is, in each of the first protruding portions 217. In addition, one end of the downstream flow path 600 is disposed to be open to a tip end surface of the second protruding portion 221, and the other end of the downstream flow path 600 is disposed to be open to the surface on the side opposite to the upstream flow path member 210 in the third direction Z. In one embodiment, the downstream flow path 600 corresponds to the connection flow path described in the scope of the claims. The downstream flow path 600 is disposed independently at each of the outlets 504 of the respective upstream flow paths 500. In other words, one upstream flow path 500 may include two outlets (a first outlet 504A and second outlet 504B). Thus the downstream flow path 600 connected to the first outlet 504A is a first connection flow path 600A and the downstream flow path 600 connected to the second outlet 504B is a second connection flow path 600B. Hereinafter, the first connection flow path 600A and the second connection flow path 600B are collectively referred to as the connection flow path 600.

In addition, the plurality of head chips 2, the two head chips 2 in one embodiment, are fixed to the surface side of the downstream flow path member 220 opposite to the upstream flow path member 210. Herein, the nozzle groups (row of the nozzles) are formed to be juxtaposed in the second direction Y as described above in one of the head chips 2, and the two head chips 2 are disposed to be juxtaposed in the second direction Y in the recording head 1. Hereinafter, the first direction X, the second direction Y, and the third direction Z of the head chip 2 respectively illustrate the same directions as the first direction X, the second direction Y, and the third direction Z of the recording head 1. The two head chips 2 that are disposed in the recording head 1 according to one embodiment are formed from the first head chip 2A and the second head chip 2B as described above. The two inlets 44 (the first inlet 44A and the second inlet 44B) are disposed in the first head chip 2A, and the six inlets 44 (three being the first inlets 44A and three being the second inlets 44B) are disposed in the second head chip 2B. The downstream flow path 600 (the first connection flow path 600A and the second connection flow path 600B) that is disposed in the downstream flow path member 220 is disposed to be open to match the position where each of the inlets 44 is open.

Herein, in one embodiment, the first head chip 2A is arranged such that the first inlet 44A is on the second head chip 2B side in the second direction Y. Likewise, the second head chip 2B is arranged such that the first inlet 44A is on the first head chip 2A side in the second direction Y. The first connection flow path 600A that is the downstream flow path 600 connects the first outlet 504A with the first inlet 44A, and the second connection flow path 600B connects the second outlet 504B with the second inlet 44B. Accordingly, the first connection flow path 600A that connects the flow path of the first head chip 2A is arranged on the further second head chip 2B side than the second connection flow path 600B. Likewise, the first connection flow path 600A that connects the flow path of the second head chip 2B is arranged on the further first head chip 2A side than the second connection flow path 600B.

In one embodiment, the first connection flow path 600A is formed in a linear shape in the third direction Z. In addition, the second connection flow path 600B has an extending flow path that extends from the second inlet 44B toward the second direction Y which is the reference direction separated from the first inlet 44A. Specifically, the second connection flow path 600B has a first flow path 601 that is connected to the upstream flow path 500 (second outlet 504B), a second flow path 602 that is an extending flow path which is connected to the first flow path 601, and a third flow path 603 that connects the second flow path 602 and the second inlet 44B with each other.

The first flow path 601 and the third flow path 603 are disposed in a linear shape in the third direction Z. The first flow path 601 and the third flow path 603 may be disposed in the direction intersecting with the third direction Z as well.

In addition, the second flow path 602, which is an extending flow path, extends toward or in the second direction Y. Herein, the extension of the second flow path 602 (extending flow path) toward the second direction Y means that a component (vector) toward the second direction Y is present in the direction of extension of the second flow path 602. The direction of extension of the second flow path 602 is the direction in which ink (liquid) in the second flow path 602 flows. Accordingly, the second flow path 602 includes those disposed in the horizontal direction (direction orthogonal to the third direction Z) and those disposed to intersect with the third direction Z and the horizontal direction (in-plane direction of the first direction X and the second direction Y). In one embodiment, the first flow path 601 and the third flow path 603 are disposed in the third direction Z and the second flow path 602 is disposed in the horizontal direction (second direction Y).

The second connection flow path 600B is not limited thereto, and a flow path other than the first flow path 601, the second flow path 602, and the third flow path 603 may also be present. The first flow path 601 or the third flow path 603 may not be disposed. In addition, a configuration in which only the second flow path 602 is the extending flow path has been described in the example described above, but, without being limited thereto, two flow paths that have components in the second direction Y may also be extending flow paths. However, the number of the extending flow paths disposed may only be one (only the second flow path 602), rather than two, because bubbles are likely to remain. In this case, bubble dischargeability can be improved.

In addition, the second connection flow path 600B, which extends in a linear shape, may be disposed to be inclined at an angle to the third direction Z. In other words, the entire second connection flow path 600B may be the extending flow path. However, a space exclusive to the second connection flow path 600B can be saved and the recording head 1 can be compact in size when the vertical first flow path 601, the vertical third flow path 603, and the horizontal second flow path 602 are disposed.

When the second flow path 602, which is an extending flow path, is disposed in the second connection flow path 600B in this manner, a gap in the second direction Y between an area where the first connection flow path 600A and the first outlet 504A communicate with each other and an area where the second connection flow path 600B and the second outlet 504B communicate with each other can be wider than a gap between the first inlet 44A and the second inlet 44B, without widening a gap in the second direction Y between the first inlet 44A and the second inlet 44B of the head chip 2.

In this manner, the wiring member 121 and the wiring substrate 300 can be connected with ease between the first connection flow path 600A and the second connection flow path 600B, with no increase in the size of the head chips 2, which will be described in detail later.

In addition, the distance (in the second direction Y) between the first outlet 504A and the second outlet 504B can be increased when the second flow path 602, which is an extending flow path, is disposed in the second connection flow path 600B. As such, a large area for the filter 216 (between the first liquid reservoir portion 502*a* and the second liquid reservoir portion 503*a*), which is the common flow path, can be ensured. Herein, flow path resistance increases since the filter 216 is disposed. Thus the filter 216 is required to have a certain degree of size to ensure a flow rate. However, the area where the filter 216, which is the common flow path allowing the first inlet 44A and the second inlet 44B to communicate, is disposed decreases in a case where the first inlet 44A and the second inlet 44B are close to each other due to a decrease in the size of a head chip 2 and the extending flow path is not disposed in the second connection flow path 600B. In other words, the area where the filter 216 is disposed can also be ensured with ease and the disadvantage described above can be addressed in a case where the head chip 2 is large and the distance between the first inlet 44A and the second inlet 44B is long (manifolds 100 are far from each other). In one embodiment, the extending flow path (second flow path 602) is disposed in the second connection flow path 600B. Thus a state where the head chip 2 is compact in size can be ensured, and a large area of the filter 216 can be ensured without separating the first inlet 44A and the second inlet 44B from each other.

The connection flow path 600 is formed, for example, from a first downstream flow path member 222 and a second downstream flow path member 223. The first flow path 601 is formed in the first downstream flow path member 222, and the second flow path 602 is formed between the first downstream flow path member 222 and the second downstream flow path member 223. In addition, the third flow path 603 is formed in the second downstream flow path member 223. In this manner, the second flow path 602, which is an extending flow path, can be formed with ease in the downstream flow path member 220.

In addition, in one embodiment, the first inlet 44A of the first head chip 2A is disposed on the second head chip 2B side, and thus the second connection flow path 600B of the first head chip 2A is arranged on the side opposite to the second head chip 2B. Likewise, the first inlet 44A of the second head chip 2B is on the first head chip 2A side, and thus the second connection flow path 600B of the second head chip 2B is arranged on the side opposite to the first head chip 2A. In this manner, the first connection flow path 600A, which is linearly disposed in the third direction Z, is arranged inside the two head chips 2 in one embodiment. Accordingly, the two head chips 2 can be arranged close to each other, without separating the two head chips 2 in the second direction Y, and the recording head 1 can be compact in size.

In addition, a wiring member insertion hole 224 is disposed between the first connection flow path 600A and the second connection flow path 600B for the wiring member 121 to be inserted therein. The wiring member insertion hole 224 communicates with the connection port 43 of the head chip 2 and allows the wiring member 121 to be inserted from the head chip 2 side to the upstream flow path member 210 side. The wiring member insertion hole 224 is disposed as an opening having substantially the same width as the width of the head chip 2 in the first direction X.

The seal member 230, which is a joint connecting (linking) the upstream flow paths 500 and the downstream flow paths 600 with each other, is disposed between the upstream flow path member 210 and the downstream flow path member 220.

The seal member 230 has liquid resistance to a liquid, such as ink, used in the recording head 1 and an elastically deformable material (elastic material), such as rubber and an elastomer, can be used in the seal member 230. The seal member 230 includes a tube-shaped part 231 in each of the downstream flow paths 600. A communicating flow path 232 is disposed in the tube-shaped part 231. The upstream flow path of the upstream flow path member 210 and the downstream flow path of the downstream flow path member 220 communicate with each other via the communicating flow path 232 of the tube-shaped part 231.

An annular-shaped first concave portion 233, into which the first protruding portion 217 is inserted, is disposed in an end surface of the tube-shaped part 231 on the upstream flow path member 210 side. In addition, a second concave portion 234, into which the second protruding portion 221 is inserted, is disposed in an end surface of the tube-shaped part 231 on the downstream flow path member 220 side. The tube-shaped part 231 is held, in a state where a predetermined pressure is applied in the third direction Z, between the tip end surface of the first protruding portion 217 inserted into the first concave portion 233 and the tip end surface of the second protruding portion 221 inserted into the second concave portion 234. In this manner, the upstream flow path 500 and the communicating flow path 232 are connected in a state where pressure is applied in the third direction Z to the seal member 230, and the communicating flow path 232 and the downstream flow path 600 are connected in a state where pressure is applied in the third direction Z to the seal member 230. Accordingly, the upstream flow path 500 and the downstream flow path 600 communicate in a state where the upstream flow path 500 and the downstream flow path 600 are sealed via the communicating flow path 232. In addition, in one embodiment, the tube-shaped part 231 (communicating flow path 232) is included in the connection flow path 600.

The first protruding portion 217 may extend to the downstream flow path member 220 side beyond the wiring substrate 300 (described in detail later). In this case, the flow path beyond the wiring substrate 300 is included in the connection flow path 600. In other words, the connection flow path 600 is a flow path that connects the second liquid reservoir portion 503*a* with the inlet 44, and may be disposed beyond the wiring substrate 300.

A plurality of the tube-shaped parts 231 according to one embodiment are connected on the upstream flow path member 210 side, by a plate-shaped part, so that the plurality of tube-shaped parts 231 are integrated with respect to the one upstream flow path member 210. In one embodiment, the eight outlets 504 of the upstream flow path 500 are disposed in the one upstream flow path member 210, and thus the eight tube-shaped parts 231 are integrally disposed in the seal member 230.

In addition, in one embodiment, pressure is applied in the third direction Z to the seal member 230 to connect the upstream flow path 500 and the downstream flow path 600 with each other. However, embodiments of the invention are not limited thereto. For example, the flow paths may be connected by bringing an inner wall surface of the tube-shaped part 231 and an outer circumferential surface of at least one of the first protruding portion 217 and the second protruding portion 221 into close contact with each other, that is, by applying pressure in the plane direction of the first direction X which is a radial direction and the second direction Y.

In addition, the wiring substrate 300, to which the wiring member 121 is connected, is disposed between the seal member 230 and the downstream flow path member 220. Insertion holes, into which the wiring member 121 and the tube-shaped part 231 of the seal member 230 are inserted, are disposed in the wiring substrate 300. Disposed in one embodiment are a first insertion hole 301, which is an opening portion where the tube-shaped part 231 disposed to correspond to the first connection flow path 600A and the wiring member 121 are inserted, and a second insertion hole 302, which is an opening portion where the tube-shaped part 231 disposed to correspond to the second connection flow path 600B is inserted.

The first insertion hole 301 may be formed to have a size that allows two wiring members 121 to be inserted. The four first connection flow paths 600A of the two head chips 2 are disposed between the two wiring members 121 (see e.g., FIG. 6). Thus the tube-shaped part 231 of the seal member 230 which corresponds to the first connection flow path 600A is inserted into the first insertion hole 301 with the wiring member 121.

In addition, the second insertion hole 302 corresponds to the second connection flow path 600B. The second insertion hole 302 is disposed to accommodate each of the tube-shaped parts 231 and is disposed to correspond to the second connection flow path 600B.

In other words, the wiring substrate 300 is arranged, on the side opposite to the first inlet 44A from the second flow path 602 which is the extending flow path of the second connection flow path 600B in the third direction Z, to extend in the second direction Y beyond the second connection flow path 600B from between the first connection flow path 600A and the second connection flow path 600B. In one embodiment, one wiring substrate 300 that is common to the two head chips 2 may be disposed. Accordingly, the wiring substrate 300 extends in the second direction Y from the side of the second connection flow path 600B, which is disposed for the first head chip 2A, opposite to the first connection flow path 600A to the side of the second connection flow path 600B for the second head chip 2B opposite to the first connection flow path 600A through between the first connection flow path 600A for the first head chip 2A and the first connection flow path 600A for the second head chip 2B. The wiring substrate 300 is not limited thereto and may be disposed, in a divided manner, in each of the head chips 2. Even in this case, the wiring substrate 300 that is disposed in each of the head chips 2 is arranged to extend in the second direction Y beyond the second connection flow path 600B from between the first connection flow path 600A and the second connection flow path 600B, and thus the wiring member 121 and the wiring substrate 300 can be connected with ease. When the one common wiring substrate 300 is used in the two head chips 2, the number of components can be reduced and the assembly operation can be simplified.

In addition, the first insertion hole 301 can be disposed with a wider opening area when the two wiring members 121 and the two first connection flow paths 600A are inserted into the first insertion hole 301, which is one of opening portions of the wiring substrate 300, than in a case where a plurality of the opening portions are disposed. As such, the wiring member 121 can be drawn out with ease from the first insertion hole 301 and assemblability can be improved. In other words, the wiring member 121 has to be drawn out from the head chip 2 side of the wiring substrate 300 to the upstream flow path member 210 side so that the wiring member 121 and the wiring substrate 300 are connected to each other. It is difficult to insert the wiring substrate 300, which has flexibility, into a narrow opening.

In addition, the wiring member 121 that is inserted into the first insertion hole 301, which is one of the opening portions of the wiring substrate 300, is in an upright state in the third direction Z and the two first connection flow paths 600A, which are inserted into the first insertion hole 301, are disposed in a linear shape in the third direction Z. As such, the opening area of the first insertion hole 301 can be as small as possible.

In addition, on the upstream flow path member 210 side surface of the wiring substrate 300, terminal portions 310, to which the wiring member 121 is connected, are disposed in open edge portions on both sides of the first insertion hole 301 in the second direction Y. The terminal portions 310 are formed over a width that is substantially equal to the width of the wiring member 121 in the first direction X. The terminal portion 310 is formed not beyond the second insertion hole 302 to which the tube-shaped part 231, which is disposed to correspond to the second connection flow path 600B, is inserted. In other words, the terminal portion 310 is disposed between the first connection flow path 600A (first insertion hole 301) and the second connection flow path 600B (second insertion hole 302).

The other end portion of the wiring member 121 is inserted into the first insertion hole 301 of the wiring substrate 300 from the downstream flow path member 220 side. The other end portion of the wiring member 121 that is inserted into the first insertion hole 301 in this manner is bent in the second direction Y on the surface (surface on the upstream flow path member 210 side) of the wiring substrate 300 and is connected to the terminal portions 310 on the surface of the wiring substrate 300 on the upstream flow path member 210 side. In other words, the surface of the connection between the wiring member 121 and the wiring substrate 300 (terminal portions 310) is in the direction along the surface of the wiring substrate 300, that is, in the in-plane direction of the first direction X and the second direction Y.

When the other end portion of the wiring member 121 is bent in this manner, the wiring member 121 can have a low back and the recording head 1 can be compact in size in the third direction Z.

A direction in which the wiring member 121 is bent is the second direction Y which is separated from the first inlet 44A in this embodiment. In other words, the other end portion of the wiring member 121 and the wiring substrate 300 are connected in an area overlapping between the first connection flow path 600A and the second connection flow path 600B (second direction Y) in the third direction Z.

When the other end portion of the wiring member 121 is bent in the second direction Y separated from the first inlet 44A in this manner, the space (connection area) connecting the wiring member 121 with the wiring substrate 300 and the space that is widened in the second direction Y by the second flow path 602, which is the extending flow path of the second connection flow path 600B, can be shared. In other words, the area connecting the wiring member 121 with the wiring substrate 300 can be ensured when the second flow path 602, which is an extending flow path, is disposed in the second connection flow path 600B. In this manner, the recording head 1 can be compact in size in the second direction Y.

In a case where the direction in which the wiring member 121 is bent is the second direction Y separated from the second inlet 44B, the terminal portion 310 (area of the wiring substrate 300 where the terminal portion 310 is disposed) is required between the two wiring members 121 and a space is required so that the terminal portions 310 of the two wiring members 121 do not interfere with each other, and thus the size of the wiring substrate 300 in the second direction Y increases and the size of the recording head 1 increases. In addition, in a case where the other end portion of the wiring member 121 is bent in the second direction Y separated from the first inlet 44A and is connected to the wiring substrate 300 with no extending flow path disposed, the gap in the second direction Y between the first inlet 44A and the second inlet 44B of the head chip 2 has to be widened so as to ensure the space where the terminal portion 310 is disposed, and thus the size of the head chip 2 increases and the size of the recording head 1 increases. In other words, in one embodiment, the second flow path 602, which is an extending flow path extending in the second direction Y, is disposed in the second connection flow path 600B and the other end portion of the wiring member 121 is bent in the second direction Y separated from the first inlet 44A and is connected with the wiring substrate 300 so that the wiring member 121 and the wiring substrate 300 can be connected at a position overlapping in the third direction Z between the first connection flow path 600A and the second connection flow path 600B without widening the gap between the first inlet 44A and the second inlet 44B of the head chip 2.

In addition, the wiring substrate 300 is disposed at the position overlapping in the third direction Z between the first connection flow path 600A and the second connection flow path 600B, and thus the wiring member 121 does not have to be drawn outside the downstream flow path 600 from between the first connection flow path 600A and the second connection flow path 600B. Disconnection or the like, which is attributable to excessive bending of the sheet-shaped wiring member 121, can be suppressed.

In addition, the wiring member 121 and the wiring substrate 300 are connected on the surface of the wiring substrate 300 on the upstream flow path member 210 side such that the wiring member 121 is connected to the terminal portion 310 along the surface of the wiring substrate 300. In other words, the wiring member 121 and the terminal portion 310 of the wiring substrate 300 are connected to overlap in the third direction Z.

When the wiring member 121 and the terminal portion 310 of the wiring substrate 300 are connected at the position overlapping in the third direction Z, the connection between the wiring member 121 and the wiring substrate 300 can be performed with ease from the one surface (upstream flow path member 210) side and assemblability can be improved. In other words, the assembly can be facilitated and the wiring member 121 and the wiring substrate 300 can be connected with ease when the head chip 2 is fixed to the downstream flow path member 220 and the wiring member 121 is inserted into the wiring member insertion hole 224 and then the end portion of the wiring member 121 inserted into the wiring member insertion hole 224 is connected to the wiring substrate 300. For example, the wiring member 121 and the wiring substrate 300 are required to be connected in advance and then the head chip 2 is required to be fixed to the downstream flow path member 220 in order to connect the wiring member 121 with the wiring substrate 300 on the surface of the wiring substrate 300 on the downstream flow path member 220 side. In a case where the assembly is performed through this process, the wiring member 121 has to be lengthened so that the connected state can be maintained between the wiring member 121 and the wiring substrate 300 even in a state where the head chip 2 and the downstream flow path member 220 are not fixed, which results in high costs. In addition, when the head chip 2 and the downstream flow path member 220 are fixed, deflection occurs in the lengthened wiring member 121, the wiring on the wiring member 121 is subjected to damage due to contact with other members, and inconvenience such as breaking of the wiring or a short circuit may occur. In one embodiment, the wiring member 121 and the wiring substrate 300 are connected on the surface of the wiring substrate 300 on the upstream flow path member 210 side so that the wiring member 121 and the terminal portion 310 of the wiring substrate 300 overlap in the third direction Z. As a result, deflection is unlikely to occur after the assembly of the wiring member 121 and the wiring member 121 can be disposed at the shortest distance (length) at which the head chip 2 and the wiring substrate 300 are linked. Accordingly, the costs can be reduced.

Furthermore, in one embodiment, the second connection flow paths 600B of the two head chips 2 are arranged on an outer side in the second direction Y, and thus the gap in the second direction Y between the two head chips 2 can be narrowed and the recording head 1 can be compact in size.

In addition, in one embodiment, the wiring member 121 is arranged such that the surface side where the drive circuit 120 is disposed is the second inlet 44B and the side opposite to the surface where the drive circuit 120 is disposed is the first inlet 44A as described above. In other words, the distance between the drive circuit 120 and the second inlet 44B is shorter than the distance between the drive circuit 120 and the first inlet 44A. The drive circuit 120 is arranged in the space between the wiring substrate 300 and the downstream flow path member 220. Herein, since the drive circuit 120 has a predetermined thickness, the width of the connection port 43 of the case member 40 in the second direction Y has to be increased for the case member 40 to be arranged in the drive circuit 120. This results in an increase in the size of the head chip 2 caused by an increase in the size of the case member 40. Accordingly, it is preferable that the drive circuit 120 be disposed in the space between the wiring substrate 300 and the downstream flow path member 220. In one embodiment, the space where the drive circuit 120 is arranged (space between the wiring substrate 300 and the downstream flow path member 220) and the space where the second flow path 602, which is an extending flow path, is widened (connection area between the wiring member 121 and the wiring substrate 300) can be shared, and thus the recording head 1 can be space-saving and can be compact in size.

When the drive circuit 120 is arranged on the first inlet 44A side, the space between the wiring substrate 300, where the drive circuit 120 is arranged, and the downstream flow path member 220 is required on the first inlet 44A side and the widths of the two head chips 2 in the second direction Y have to be widened, which results in an increase in the size of the recording head 1. In other words, in one embodiment, the drive circuit 120 is disposed on the second inlet 44B side, and thus no space is required on the first inlet 44A side for the drive circuit 120 to be arranged. Thus, the gap between the two head chips 2 can be narrowed, and the recording head 1 can be compact in size.

In addition, noise resistance can be improved, signal distortion can be suppressed, and heat loss can be suppressed since the drive circuit 120 can be arranged close to the piezoelectric actuators 130.

Wiring (not illustrated), electronic components (not illustrated), and the like are mounted on the wiring substrate 300, and the wiring that is connected to the terminal portions 310 is connected to connectors 320 that are disposed on both end portion sides in the second direction Y. External wiring (not illustrated) is connected to the connectors 320. A connector connection port 225 that exposes the connectors 320 is disposed in the downstream flow path member 220, and the external wiring is connected to the connectors 320 that are exposed by the connector connection port 225.

A method for fixing the flow path member 200 and head chips 2 is not particularly limited, and examples thereof may include adhesion by using an adhesive and fixing by using a screw. However, fixing via a seal member formed of an elastic material is difficult because the head chips 2 are small in size and a plurality of the head chips 2 have to be mounted on the single flow path member 200. Accordingly, the head chips 2 and the flow path member 200 may be adhered using an adhesive.

In addition, the cover head 400 is disposed on the surface side of the flow path member 200 where the head chip 2 is disposed. In one embodiment, the cover head 400 has a sufficient size to cover the plurality of head chips 2. In addition, a second exposing opening portion 401, which exposes the nozzles 21, is disposed in the cover head 400. In one embodiment, the second exposing opening portion 401 has a sufficient size to expose the nozzle plate 20, that is, an opening substantially the same as the first exposing opening portion 45*a* of the compliance substrate 45.

The cover head 400 is bonded to the surface side of the compliance substrate 45 opposite to the communicating plate 15 and seals the space on the side of the compliance portion 49 opposite to the flow path (manifold 100). When the compliance portion 49 is covered by the cover head 400 in this manner, breakage of the compliance portion 49 attributable to contact with a recording medium such as paper can be suppressed. In addition, attachment of ink (liquid) to the compliance portion 49 can be suppressed, ink (liquid) attached to a surface of the cover head 400 can be wiped with, for example, a wiper blade, and contamination of the recording medium by ink attached to the cover head 400 or the like can be suppressed. Although not particularly illustrated, a space between the cover head 400 and the compliance portion 49 is open to the atmosphere. The cover head 400 may also be disposed independently in each of the head chips 2.

Embodiments of the invention have been described above, but the basic configuration of the invention is not limited to the above description.

For example, two head chips 2 may be disposed in the recording head 1 according to the embodiments described above, but the number of the head chips 2 is not particularly limited thereto. The recording head 1 may include only one head chip or the recording head 1 may include three or more head chips 2. In addition, an example in which the first head chip 2A and the second head chip 2B are configured to be disposed in the recording head 1 has been described above, but embodiments of the invention are not limited thereto and only one of the first head chip 2A and the second head chip 2B may be disposed in the recording head 1. The configuration of the head chip 2 is not limited to the first head chip 2A and the second head chip 2B described above.

In addition, the first connection flow path 600A and the second connection flow path 600B that are connected to one of the head chips 2 are connected to the upstream flow path 500, which is a common flow path that may be common. However, the embodiments of the invention are not particularly limited thereto, and the first connection flow path 600A and the second connection flow path 600B may communicate with respective flow paths independent from each other. In a case where the first inlet 44A and the second inlet 44B are configured to communicate with the common flow path as described above, it is difficult for the wiring member 121 that is disposed between the first inlet 44A and the second inlet 44B to extend outside the flow path beyond the common flow path. However, since the wiring member 121 is connected with the wiring substrate 300 between the first connection flow path 600A and the second connection flow path 600B, the wiring member 121 does not have to extend beyond the common flow path.

Furthermore, although the two wiring members 121 and the four first connection flow paths 600A are inserted into the first insertion hole 301 in the first embodiment described above, embodiments are not particularly limited thereto and the insertion hole into which the wiring member 121 is inserted and the insertion hole into which the first connection flow path 600A is inserted may be disposed independently of each other. In addition, the rows of the first connection flow paths 600A juxtaposed in the first direction X may be inserted into one insertion hole, and the insertion hole may be disposed independently for each of the first connection flow paths 600A. However, assemblability can be improved when the two wiring members 121 and the four first connection flow paths 600A are inserted into the first insertion hole 301 as described above.

Furthermore, the flow path member 200 that includes the upstream flow path member 210 where the upstream flow path 500 is disposed and the downstream flow path member 220 where the downstream flow path 600 is disposed has been described as an example in the embodiments described above, but the upstream and the downstream directions may be reversed in a case where ink (liquid) is circulated. In other words, ink that is supplied to the head chips 2 may be allowed to flow from the downstream flow path 600 to the upstream flow path 500 and may be discharged (circulated) to the liquid holding portion, a storage portion where discharge ink is stored, and the like.

In addition, the thin film type piezoelectric actuator 130 has been used in the description of the first embodiment above as the pressure generating unit that causes pressure change in the pressure generating chamber 12, but embodiments are not limited thereto. For example, a thick film type piezoelectric actuator that is formed by using a method such as green sheet pasting, a vertical vibration type piezoelectric actuator in which a piezoelectric material and an electrode forming material are stacked alternately to be expanded and contracted in an axial direction, and the like can also be used. In addition, liquid droplets may be discharged from a nozzle opening by using bubbles that are generated through heating by heater elements which are arranged in a pressure generating chamber as a pressure generating unit, a so-called electrostatic actuator that discharges liquid droplets from a nozzle opening by deforming a vibrating plate with the electrostatic force of static electricity that is generated between the vibrating plate and an electrode, and the like can also be used as pressure generating units.

Figure 8:
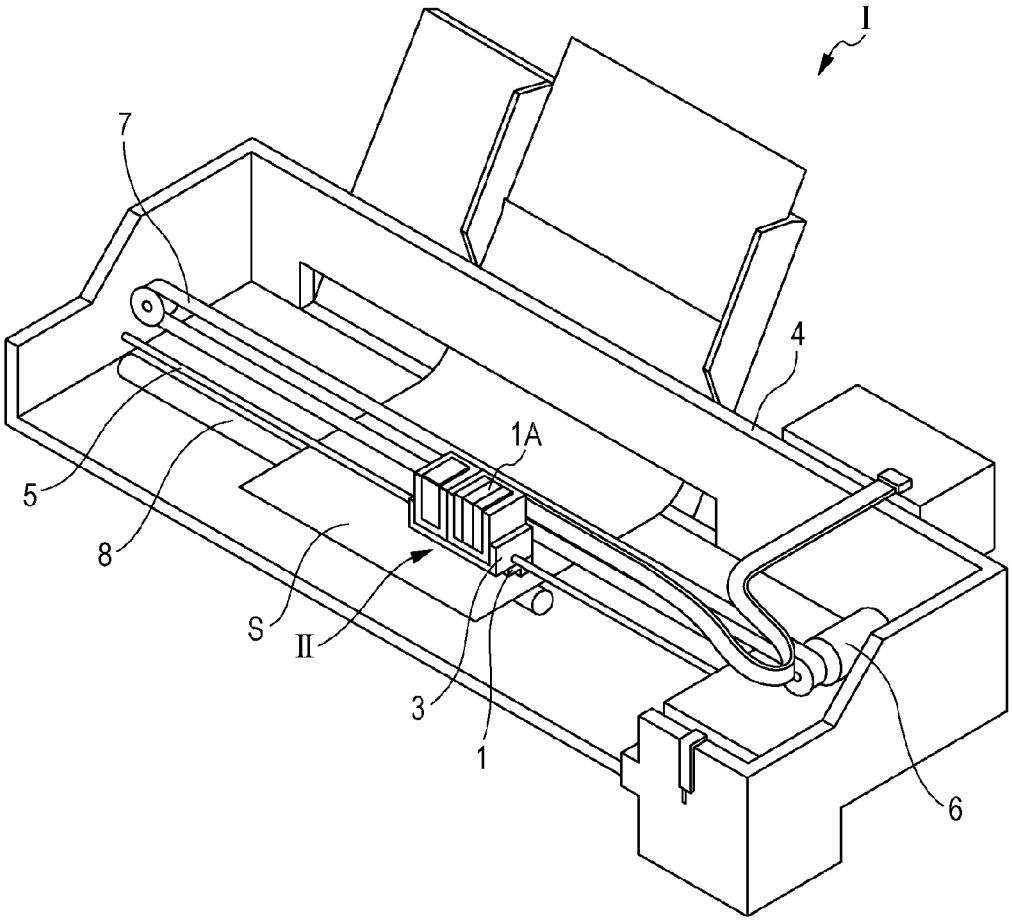
FIG. 8 is a schematic perspective view of an example recording apparatus

In addition, the ink jet type recording head 1 may constitute a part of an ink jet type recording head unit that includes an ink flow path which communicates with an ink cartridge and the like, and is mounted on an ink jet type recording apparatus. FIG. 8 is a schematic view illustrating an example of the ink jet type recording apparatus.

In an ink jet type recording head unit II (hereinafter, referred to the head unit II), which has a plurality of the ink jet type recording heads 1, of an ink jet type recording apparatus I illustrated in FIG. 8, a cartridge 1A that constitutes the liquid holding portion is removably disposed and a carriage 3, on which the head unit II is mounted, is disposed on a carriage shaft 5, which is mounted on an apparatus main body 4, to be movable in the axial direction. The recording head unit II may discharge, for example, a black ink composition and a color ink composition.

When the driving force of a drive motor 6 is transmitted to the carriage 3 via a plurality of gears (not illustrated) and a timing belt 7, the carriage 3 that is mounted on the head unit II is moved along the carriage shaft 5. A platen 8 is disposed along the carriage shaft 5 in the apparatus main body 4. A recording sheet S, which is a recording medium such as paper fed by a feed roller (not illustrated), is wound around the platen 8 and transported.

In addition, the ink jet type recording apparatus I in which the ink jet type recording head 1 (head unit II) is mounted on the carriage 3 and is moved in a main scanning direction has been described above, but the invention is not limited thereto. For example, the invention can also be applied to a so-called line type recording apparatus that performs printing by moving the recording sheet S such as paper only in a sub-scanning direction with the ink jet type recording head 1 fixed thereto.

In addition, the ink cartridge 1A, which is a liquid holding portion, is configured to be mounted on the carriage 3 in the ink jet type recording apparatus I according to the example described above, but the invention is not limited thereto. For example, the liquid holding portion such as an ink tank may be fixed to the apparatus main body 4 and the liquid holding portion and the ink jet type recording head 1 may be connected via a supply tube such as a tube. In addition, the liquid holding portion may not be mounted on the ink jet type recording apparatus.

Furthermore, embodiments of the invention target a wide range of liquid ejecting heads in general. For example, embodiments can also be applied to recording heads such as various types of ink jet type recording heads used in image recording apparatuses such as printers, color material ejecting heads used in manufacturing color filters such as liquid crystal displays, electrode material ejecting heads used in forming electrodes such as organic EL displays and field emission displays (FED), bio-organic material ejecting heads used in manufacturing biochips, and the like.

What is claimed is:

1. A liquid ejecting head comprising:

a head chip in which two or more nozzle groups, each being configured by a plurality of nozzles, are disposed in a reference direction on a liquid ejecting surface, wherein the head chip includes a first inlet that is disposed on a surface side opposite to the liquid ejecting surface to communicate with one of the nozzle groups and a second inlet that communicates with the other nozzle group, wherein the first inlet and the second inlet are disposed in the reference direction;

a wiring member with a first end portion connected to a pressure generating unit, which is disposed between the first inlet and the second inlet to generate a pressure change in a flow path in the head chip, and a second end portion extending in the direction opposite to a direction of liquid ejection from the nozzles;

a first connection flow path that is connected to the first inlet;

a second connection flow path that is connected to the second inlet; and a wiring substrate to which the second end portion of the wiring member is connected between the first connection flow path and the second connection flow path, wherein the second connection flow path includes an extending flow path that extends from the second inlet toward the reference direction separated from the first inlet, and wherein the wiring substrate is arranged on the side of the second connection flow path opposite to the first inlet from the extending flow path to extend in the reference direction beyond the second connection flow path from between the first connection flow path and the second connection flow path.

2. The liquid ejecting head according to claim 1, wherein the first connection flow path and the second connection flow path are connected to a common flow path that is common on the side of the wiring substrate opposite to the first inlet and the second inlet.

3. A liquid ejecting apparatus comprising the liquid ejecting head according to claim 2.

4. The liquid ejecting head according to claim 1, further comprising:

a first head chip where the two or more nozzle groups are disposed and a second head chip where the two or more nozzle groups are disposed, wherein the first inlet and the second inlet are respectively disposed in the first head chip and in the second head chip, and wherein the first head chip and the second head chip are disposed in a first direction so that the first inlet is on the second head chip side in the first head chip and the first inlet is on the first head chip side in the second head chip.

5. The liquid ejecting head according to claim 4, wherein the wiring substrate includes an opening portion into which the first connection flow path of the first head chip and the first connection flow path of the second head chip are inserted.

6. The liquid ejecting head according to claim 5, wherein the wiring member of the first head chip and the wiring member of the second head chip are inserted into the opening portion.

7. A liquid ejecting apparatus comprising the liquid ejecting head according to claim 6.

8. A liquid ejecting apparatus comprising the liquid ejecting head according to claim 4.

9. The liquid ejecting head according to claim 5, wherein the first connection flow path is linearly formed in the direction of liquid ejection, wherein the first connection flow path of the first head chip, the first connection flow path of the second head chip, the wiring member that is disposed to be upright in the direction of liquid ejection of the first head chip, and the wiring member that is disposed to be upright in the direction of liquid ejection of the second head chip are inserted into the opening portion.

10. A liquid ejecting apparatus comprising the liquid ejecting head according to claim 9.

11. A liquid ejecting apparatus comprising the liquid ejecting head according to claim 5.

12. The liquid ejecting head according to claim 1, wherein the second end portion side of the wiring member is bent along a surface of the wiring substrate in a direction separated from the first inlet in the first direction and is connected to the wiring substrate.

13. A liquid ejecting apparatus comprising the liquid ejecting head according to claim 12.

14. The liquid ejecting head according to claim 1, wherein a terminal portion is disposed on the surface of the wiring substrate and a surface of connection between the wiring member and the terminal portion is in a direction along the surface of the wiring substrate.

15. A liquid ejecting apparatus comprising the liquid ejecting head according to claim 14.

16. The liquid ejecting head according to claim 1, wherein the extending flow path extends in a horizontal direction that is orthogonal to the direction of liquid ejection.

17. A liquid ejecting apparatus comprising the liquid ejecting head according to claim 16.

18. The liquid ejecting head according to claim 1, wherein the wiring member is formed from a sheet-shaped member, a drive circuit that drives the pressure generating unit is disposed on one surface of the wiring member, and the distance from the drive circuit to the second inlet is shorter than the distance from the drive circuit to the first inlet.

19. A liquid ejecting apparatus comprising the liquid ejecting head according to claim 18.

20. A liquid ejecting apparatus comprising the liquid ejecting head according to claim 1.

* * * * *